US006601746B2

(12) United States Patent
Buckley et al.

(10) Patent No.: US 6,601,746 B2
(45) Date of Patent: Aug. 5, 2003

(54) TABLET SPLITTING DEVICE

(75) Inventors: Thomas L. Buckley, Lagune Niguel, CA (US); John I. Muri, Aliso Viejo, CA (US)

(73) Assignee: Links Medical Products, Inc, Irvine, CA (US)

( * ) Notice: Subject to any disclaimer, the term of this patent is extended or adjusted under 35 U.S.C. 154(b) by 8 days.

(21) Appl. No.: 09/978,231

(22) Filed: Jan. 4, 2002

(65) Prior Publication Data

US 2002/0179669 A1 Dec. 5, 2002

Related U.S. Application Data

(63) Continuation-in-part of application No. 09/867,380, filed on May 30, 2001.

(51) Int. Cl.[7] ..... B25C 11/02

(52) U.S. Cl. ..... 225/103; 225/93; 206/528; 220/495.03

(58) Field of Search ..... 225/93, 103, 94, 225/95, 97, 98; 206/528, 540; 220/495.03, 495.01

(56) References Cited

U.S. PATENT DOCUMENTS 4,009,651 A * 3/1977 Adams ..... 99/579
4,173,826 A * 11/1979 Leopoldi et al. ..... 30/124
4,179,806 A 12/1979 Lieptz
4,330,936 A 5/1982 Swarth
4,409,843 A 10/1983 Urban et al.
4,473,192 A 9/1984 Urban et al.
4,697,344 A 10/1987 Leopoldi
4,824,000 A 4/1989 Baxter et al.
4,887,755 A * 12/1989 Gibilisco ..... 225/103
D310,731 S * 9/1990 Lieptz ..... D24/220
4,964,555 A 10/1990 Hnatuk
5,038,475 A * 8/1991 Wolff ..... 30/124
5,118,021 A * 6/1992 Fiocchi ..... 225/103
5,618,004 A * 4/1997 Klearman et al. ..... 241/21
6,318,580 B1 * 11/2001 Edy ..... 220/495.02
D468,023 S * 9/2002 Buckley et al. ..... D24/220
6,449,218 B1 * 9/2002 Lluch ..... 368/10
2002/0179666 A1 * 12/2002 Buckley et al. ..... 225/1

* cited by examiner

*Primary Examiner*—Allan N. Shoap
*Assistant Examiner*—Ghassem Alie
(74) *Attorney, Agent, or Firm*—Jerry R. Potts

(57) ABSTRACT

A manually operable tablet splitting device, including a base and a cover, pivotally attached to the base, and movable between a tablet loading position and a tablet splitting position. The cover includes a blade for splitting a tablet into two substantially equal portions. A disposable tray, having a tablet-receiving cavity, is installable in the base to fix the tablet in position for splitting and to retain the split portions. The base includes an inclined platform having upwardly projecting receptacle locators for holding the tray in place.

20 Claims, 3 Drawing Sheets

TABLET SPLITTING DEVICE

CROSS REFERENCE TO RELATED APPLICATION

This patent application is a continuation-in-part of patent application Ser. No. 09/867,380 titled "Tablet Splitting Apparatus", filed May 30, 2001. Said copending application is incorporated herein by reference.

BACKGROUND OF THE INVENTION

The present invention relates generally to patient care devices and, more particularly, to devices for splitting single tablets.

Act Modern medicines come in a variety of forms and commonly the form is that of a tablet. This can be defined generally as a small, usually soluble shaped medicated mass. Typically, a tablet contains filler and an excipient substance that facilitates working it into a form suitable for swallowing by a patient.

It is well known that tablets, such as anti-depressants, antibiotics and the like, are available wherein the active ingredient is present in a particular dose, as for example, 10, 30 or 50 milligrams per tablet. In general, the manufacturing costs are not substantially impacted by the size of the dose and the costs of production for a 10 milligram (mg) tablet, for example, are about the same as those for a 50 mg tablet. Thus, pharmaceutical companies sometimes produce tablets having a dosage that is driven, at least in part, by financial considerations.

As a result, in some cases available tablet dosages differ from those prescribed by the patient's physician and the available tablet has a dosage exceeding the patient's needs. For example, in cases where a prescription calls for a 10 mg tablet, and only a 20 mg tablet is available, it becomes necessary to split the tablet so that the patient receives the appropriate dosage.

Typically, tablets come in a variety of sizes and shapes, and, because of the manufacturing process, often have a hard outer shell. The presence of the shell can make tablet splitting a difficult, inexact and time consuming process. Occasions for splitting a tablet might arise, for example, in a pharmacy dispensing tablets or in a nursing home or private residence. In such cases, an efficient and effective single tablet splitting device would be useful. Desirably, such a device would be capable of dividing single tablets into substantially equal portions and would be operable by elderly or weak patients.

DISCLOSURE OF THE INVENTION

According to the present invention, there is provided a manually operable single tablet splitting device, including a base and a cover, pivotally attached to the base, and movable between a tablet loading position and a tablet splitting position. The cover includes a blade for splitting a tablet into two substantially equal portions. A disposable tablet tray, having a tablet-receiving cavity, is installable in the base to fix the tablet in position for splitting and to retain the split portions. The base includes an inclined platform having upwardly projecting tray locators for holding the disposable tray in place.

The present invention affords several advantages. For example, the device is efficient in use, providing a reliable technique for splitting a tablet accurately, into substantially equal portions. Since each tablet is nested in a shaped cavity within the disposable tray, the tablet is aligned for accurate splitting. In addition, the device affords sufficient mechanical advantage to the user that elderly or weak patients are able to operate the device without assistance.

Further, the use of the disposable tray isolates each tablet and its ingredients from other tablets. In this manner, the likelihood of contamination of tablets is substantially eliminated.

In summary, the tablet splitting device embodying the invention, in addition to affording substantial cost savings, is inexpensive to manufacture and reliable and dependable in performance.

Other aspects and advantages of the present invention will become apparent from the following detailed description, taken in conjunction with the accompanying drawings, illustrating by way of example the principles of the invention.

SUMMARY OF THE INVENTION

Figure 1:
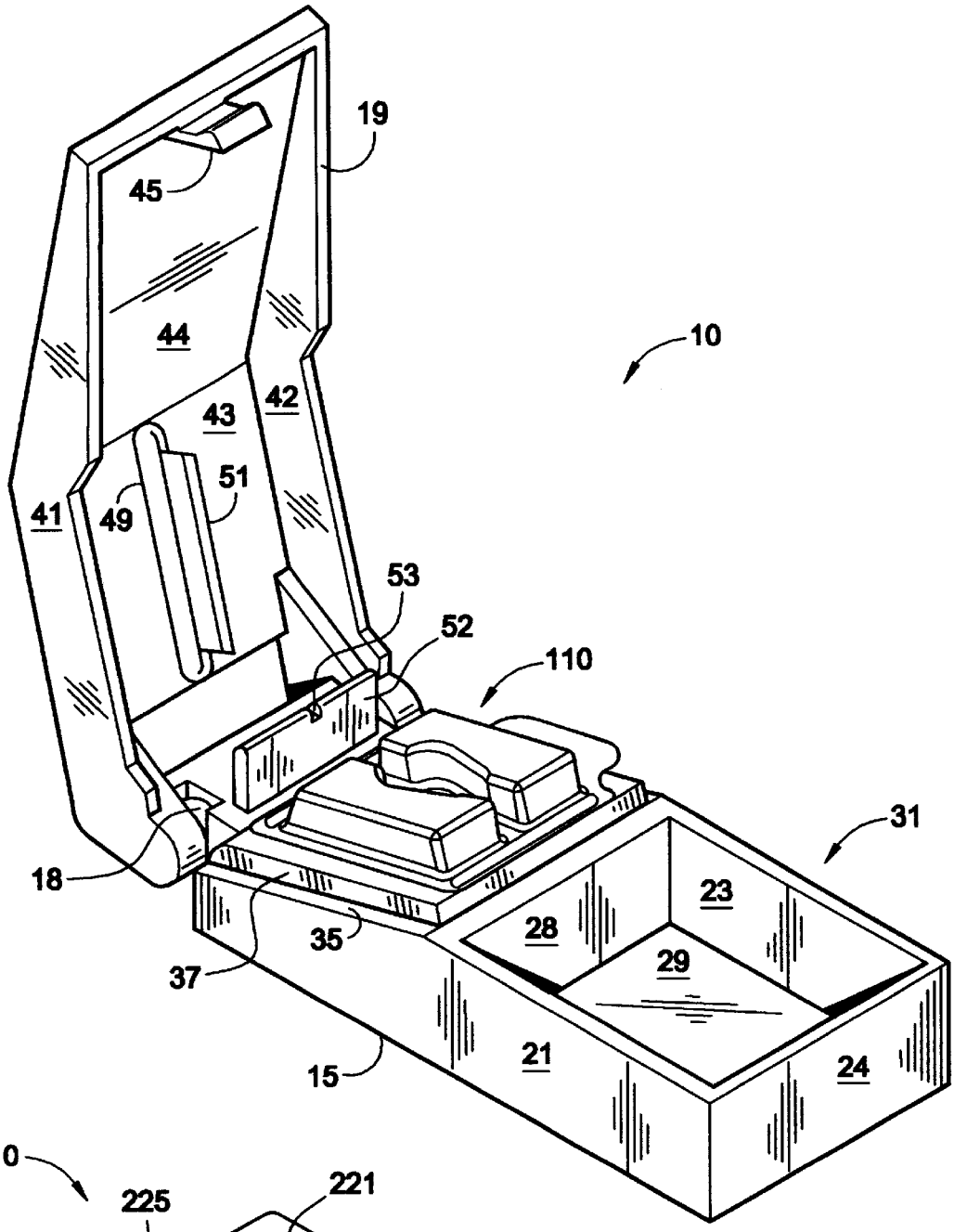
FIG. 1 is a front perspective view of a tablet splitting device that is constructed according to the present invention, showing a tray in place.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Before considering the drawings in detail, a summary of the construction and function of the present invention will be helpful. The invention is designed for splitting, into substantially equal portions, solid medication tablets of various sizes and shapes. The common shapes of tablets are: round flat, round lentil, capsule, oval flat, oval round, and modified heart. Use of a suitable tray ensures that the tablet is positioned within the tablet splitting device so that the tablet is split into substantially equal portions in a very short time, with very little effort.

In general, the tablet splitting device comprises a manually operated guillotine or blade, an inclined tablet support, and a disposable plastic tray for holding and positioning the tablet during splitting. It will be noted that, among the several advantages afforded by the present invention, the use of the disposable tray aids in preventing cross-contamination of the device when tablets having different medications are split.

BEST MODE FOR CARRYING OUT THE INVENTION

In the following detailed description and in the several figures of the drawings, like elements are identified with like reference numerals.

Figure 2:
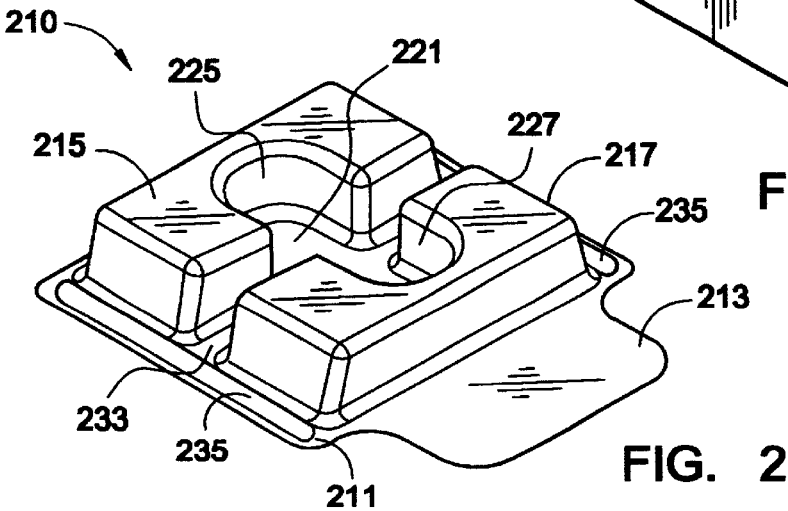
FIG. 2 is a perspective view of one embodiment of a tray utilizable in the tablet splitting device of the present invention.
Figure 3:
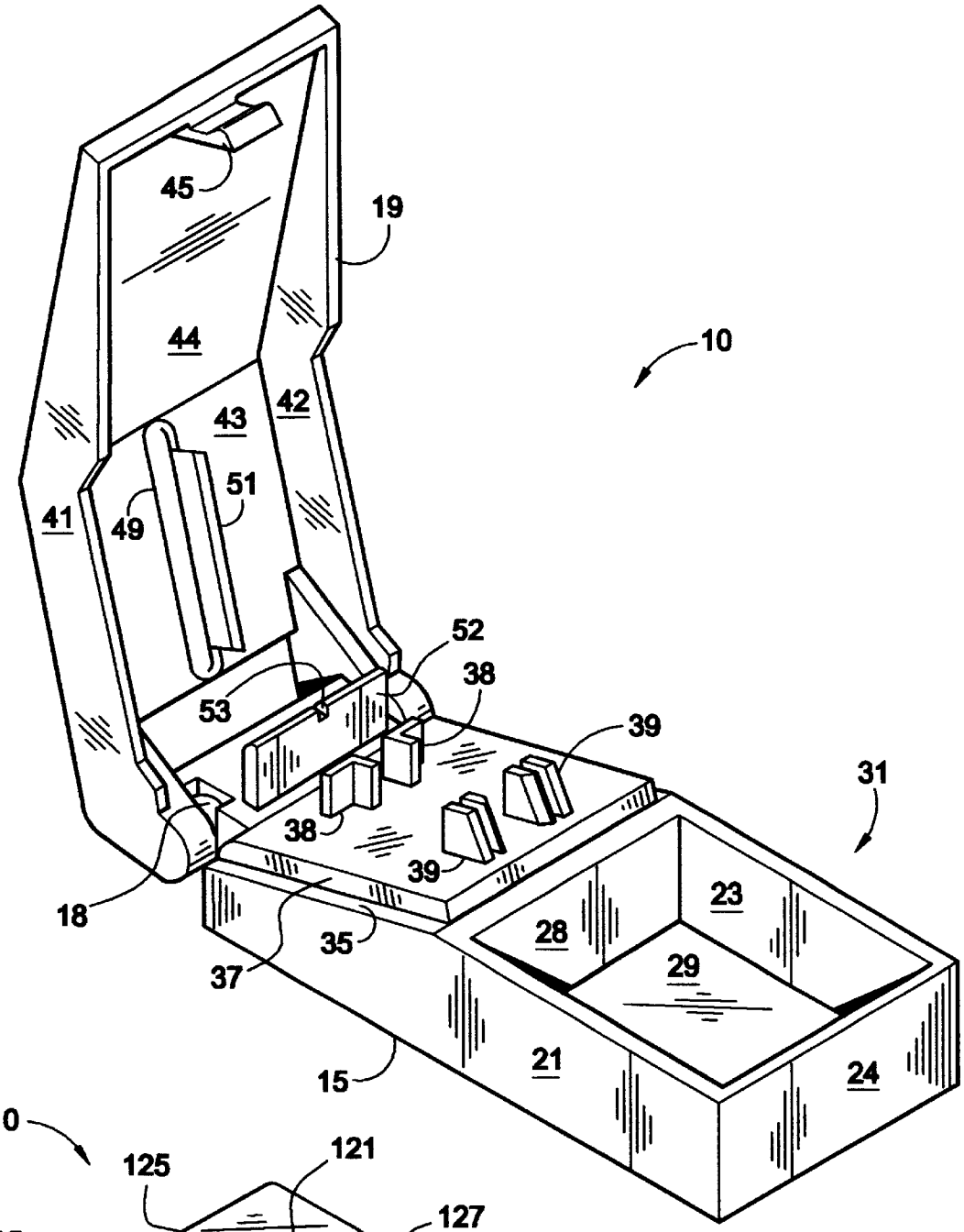
FIG. 3 is another front perspective view of the device of FIG. 1, the tray having been removed.
Figure 7:
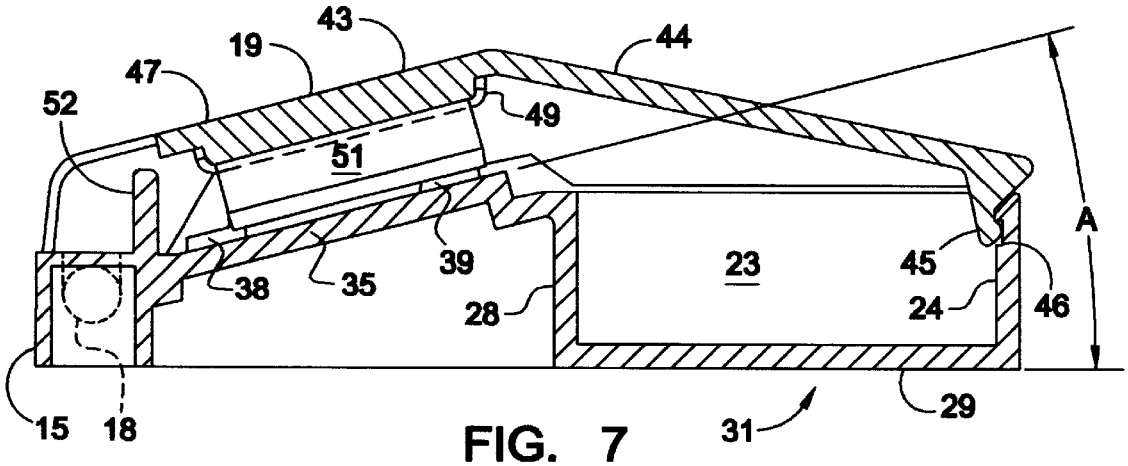
FIG. 7 is a sectional view of the device of FIG. 1.

Referring now to the drawings, and particularly FIGS. 1–3, there is shown a novel tablet splitting device 10 that is constructed according to the present invention. The tablet splitting device 10 includes an elongated rectangular base 15 and an elongated cover 19 that is pivotally attached to the base 15 at a hinge 18. The cover 19 is movable about the hinge 18 between a tablet loading position and a tablet splitting position. The cover 19 includes a pair of sidewalls 41 and 42, a top wall 43, and a sloped top wall extension 44. As shown in FIG. 7, a clasp 45, located on the extension 44 engages a recess 46 in a base end wall 24 to hold the cover 19 in a closed condition. A raised blade support 49 is disposed centrally and coaxially on the inner surface of the top wall 43. A blade 51 is fitted into the support 49. A guard 52, disposed on the inner surface of the cover 19, between the blade 51 and the hinge 18, serves to prevent any tray contents from spilling from the receptacle after a tablet has been split. An opening 53 in the guard 52 enables the blade 51 to have unimpeded contact with the tablet.

Considering now the base 15, the base includes a pair of sidewalls 21 and 23, an end wall 24, an interior wall 28 and a bottom wall 29. These walls define a compartment 31 that is useful for storage of tablets, or trays, as discussed below.

The sidewalls 21 and 23 include an inclined top 35 that is disposed between the hinge 18 and the interior wall 28. The inclined top 35 underlies a tray support platform 37. As best shown in FIG. 7, the plane of the platform 37 is inclined at an angle A of between about 30° and about 60°, preferably about 45°, relative to the plane of the bottom wall 29. This angle facilitates the cutting function of the blade 51 by enabling the tablet to be held in a desirable position for splitting.

The present invention includes a plurality of trays, each one of which including a shaped tablet-receiving cavity, as discussed more fully below. During the tablet splitting operation, a suitable tray is chosen and the tray, such as the tray 110 (FIG. 3), is positioned on the platform 37. Projecting upwardly from the platform 37 are L-shaped positioning elements 38 and positioning elements 39 which engage the underside of the tray 110 to hold it in place as the tablet is split.

To accomplish tablet splitting, while the cover 19 is in an open position, the tray 110 can be installed on the platform 37 and a tablet (not shown) can be placed in a cavity, such as the cavity 121, of the tray 110. With downward rotation of the cover 19, the blade 51 contacts the tablet to split it into substantially equal portions. As noted, the platform 37 is inclined relative to the plane of the bottom wall 29. This inclination is a significant factor in operation of the device 10 since it enables effective access of the blade 51 to the tablet.

Figure 4:
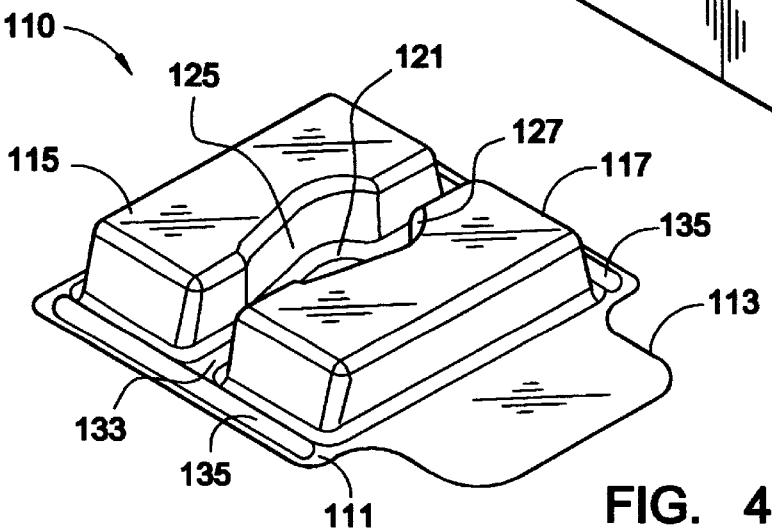
FIG. 4 is a perspective view of the tray embodiment shown in FIG. 1.

The several embodiments of the trays will now be considered. Each embodiment is constructed of thin plastic material and is disposable. For convenience, a plurality of trays can be stored in the compartment 31 of the device 10. The first tray embodiment to be considered is the tray 110 (FIGS. 1 and 4). This tray includes a base 111 supporting a pair of box-shaped structures 115 and 117 that include interior walls 131 and 133, respectively. The interior walls 131 and 133 define a shaped tablet-receiving cavity 121. It will be noted that the cavity 121 is generally pear shaped. As such, it is capable of holding a variety of different shaped tablets such as round and modified heart shaped tablets. A trough 133 is formed between the structures 115 and 117 into which the blade 51 extends during operation of the device 10. A finger engageable tab 113 extends from the base 111 for ease of the user in installing the tray 110 into the device 10.

The next tray embodiment to be considered is the tray 210 (FIG. 2). This tray is similar in structure and function to the tray 110, differing only in the shape of a tablet receiving cavity 221. The tray 210 includes a base 211 supporting a pair of box-shaped structures 215 and 217 that include interior walls 231 and 233, respectively. The interior walls 231 and 233 define the shaped tablet-receiving cavity 221. It will be noted that the cavity 221 is generally ovoid in shape. As such, it is capable of holding a variety of tablets such as oval flat, oval round and capsule. A trough 233 is formed between the structures 215 and 217 into which the blade 51 extends during operation of the device 10. A finger engageable tab 213 extends from the base 211 for ease of the user in installing the tray 210 into the device 10.

Figure 5:
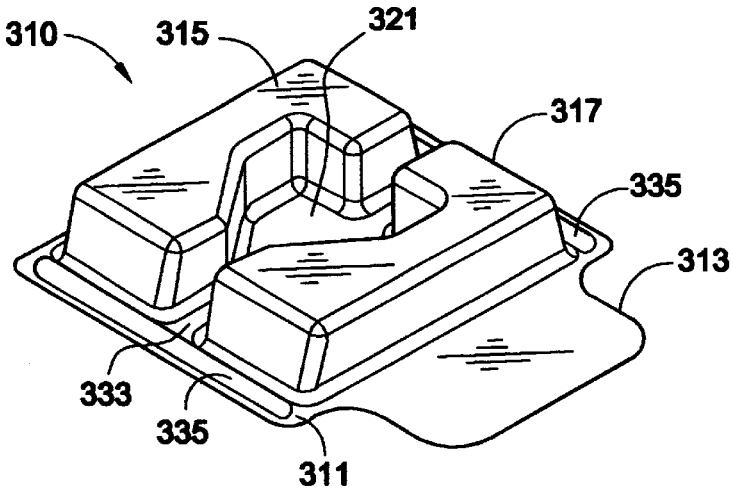
FIG. 5 is a perspective view of another embodiment of a tray utilizable in the tablet splitting device of the present invention.

The third tray embodiment to be considered is the tray 310 (FIG. 5). This tray is similar in structure and function to the tray 110, differing again in the shape of a tablet receiving cavity 321. The tray 310 includes a base 311 supporting a pair of box-shaped structures 315 and 317 that include interior walls 331 and 333, respectively. The interior walls 331 and 333 define the shaped tablet-receiving cavity 321. It will be noted that in this embodiment the cavity 321 is generally heart shaped. As such, it is capable of holding a variety of tablets such as round and modified heart shaped. A trough 333 is formed between the structures 315 and 317 into which the blade 51 extends during operation of the device 10. A finger engageable tab 313 extends from the base 311 for ease of the user in installing the tray 310 into the device 10.

Figure 6:
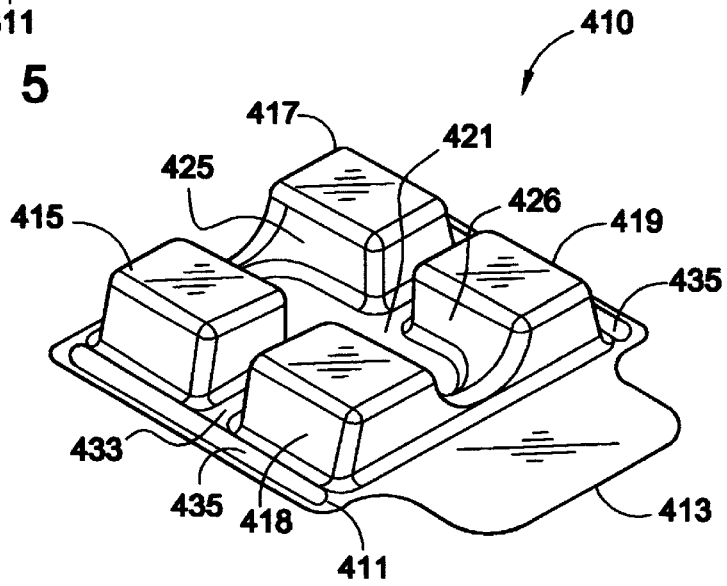
FIG. 6 is a view of yet another embodiment of a tray utilizable in the tablet splitting device of the present invention.

Yet another tray embodiment to be considered is the tray 410 (FIG. 6). This tray is similar in structure and function to the tray 110, differing only in the shape of a tablet receiving cavity 421. The tray 410 includes a base 411 supporting a pair of box-shaped structures 415 and 417 that include interior walls 431 and 433, respectively. These interior walls define an elongated ovoid shaped cavity 421. Because of its shape, the tray 410 is capable of holding a variety of tablets, especially capsules. A trough 433 is formed between the structures 415 and 417 into which the blade 51 extends during operation of the device 10. A finger engageable tab 413 extends from the base 411 for ease of the user in installing the tray 210 into the device 10.

It will be evident that there are additional embodiments and applications that are not disclosed in the detailed description but which clearly fall within the scope of the present invention. The specification is, therefore, intended not to be limiting, and the scope of the invention is to be limited only by the following claims.

What is claimed is:

1. A tablet splitting device, comprising:

a base, said base including a bottom wall;

a cover pivotally attached to said base, said cover including a blade for splitting a tablet into two portions;

a tray for holding said tablet in position to be split;

a platform for supporting said tray wherein said platform is inclined to the plane of said bottom wall at an angle of between about 30° and between about 60°; and tray locating means mounted on said platform for positioning said tray and for aligning said tray with said blade.

2. The tablet splitting device according to claim 1, wherein said platform is inclined to the plane of said bottom wall at an angle of about 45°.

3. The tablet splitting device according to claim 1, wherein said tray includes a shaped cavity wherein said cavity is adapted for receiving a tablet and for holding the received tablet in position for splitting.

4. The tablet splitting device according to claim 3, wherein said cavity is pear-shaped.

5. The tablet splitting device according to claim 3, wherein said cavity is ovoid in shape.

6. The tablet splitting device according to claim 3, wherein said cavity is heart-shaped.

7. The tablet splitting device according to claim 1, wherein said base has an elongated configuration, said base including a hinge for attaching said cover to said base and for enabling cover movement between a tablet loading position and a tablet splitting position.

8. The tablet splitting device according to claim 1, including a compartment for storing trays.

9. The tablet splitting device according to claim 1, wherein said means for locating said tray includes a pair of studs mounted on said platform.

10. A method of splitting a tablet, comprising the steps of:

providing a device for splitting said tablet, said device including a base, a bottom wall and a blade, said blade being movable between a tablet loading position and a tablet splitting position;

providing a disposable tray for receiving said tablet and for holding said tablet in position to be split;

providing a tray support platform wherein said platform is positioned at an angle of about 45° relative to the plane of said bottom wall;

positioning said tray on said platform;

loading a tablet into said tray; and moving said blade into said tablet splitting position to split said tablet into substantially equal portions.

11. The method according to claim 10, including a step of aligning said tray with said blade.

12. A tablet splitting device comprising;

a base, said base including a bottom wall;

a cover pivotally attached to said base, said cover including a blade for splitting a tablet into two portions;

a tray for holding said tablet in position to be split;

a platform for supporting said tray wherein said platform is inclined to the plane of said bottom wall at an angle of between about 30° and between about 60°, wherein said tray includes a shaped cavity wherein said cavity is adapted for receiving a tablet and for holding the received tablet in position for splitting; and tray locating means mounted on said platform for positioning said tray and for aligning said tray with said blade.

13. The tablet splitting device according to claim 12, wherein said platform is inclined to the plane of said bottom wall at an angle of about 45°.

14. The tablet splitting device according to claim 12, wherein said cavity is pear-shaped.

15. The tablet splitting device according to claim 12, wherein said cavity is ovoid in shape.

16. The tablet splitting device according to claim 12, wherein said cavity is heart-shaped.

17. The tablet splitting device according to claim 12, wherein said base has an elongated configuration, said base including a hinge for attaching said cover to said base and for enabling cover movement between a tablet loading position and a tablet splitting position.

18. The tablet splitting device according to claim 12, wherein said means for locating said tray includes a pair of studs mounted on said platform.

19. A tablet splitting device, comprising:

a tablet tray for holding a tablet in position to be split;

a platform for supporting from below said tablet tray; said platform having positioning elements for engaging said tablet tray and for holding said tablet tray in place during a tablet splitting operation; and wherein said platform is inclined from a horizontal plane at an angle A.

20. A tablet splitting device comprising:

a platform for supporting from below a tablet tray, said tablet tray including a shaped cavity for holding a tablet in position to be split;

a cover pivotally mounted adjacent to said platform, said cover having a disposable blade mounted therein for splitting a tablet into two portions; and a plurality of positioning elements projecting upwardly from said platform for engaging said tablet tray and for holding said tablet tray in place as said cover is moved from a tablet loading position to a tablet splitting position.

* * * * *